US007000799B1

(12) United States Patent
Hamre

(10) Patent No.: US 7,000,799 B1
(45) Date of Patent: Feb. 21, 2006

(54) HAND HELD SERVICE TRAY

(76) Inventor: Roger Hamre, 120 Cumberland Green Dr., Cary, NC (US) 27513

( * ) Notice: Subject to any disclaimer, the term of this patent is extended or adjusted under 35 U.S.C. 154(b) by 0 days.

(21) Appl. No.: 10/905,293

(22) Filed: Dec. 24, 2004

(51) Int. Cl.
*B65D 1/24* (2006.01)
*B65D 1/36* (2006.01)
*B65D 25/04* (2006.01)
*B65D 57/00* (2006.01)
*B65D 85/00* (2006.01)

(52) U.S. Cl. ..... 220/556; 220/23.8; 220/575

(58) Field of Classification Search ..... 220/23.8, 220/23.86, 556, 575; 206/217, 564, 565
See application file for complete search history.

(56) References Cited

U.S. PATENT DOCUMENTS 3,401,858 A 9/1968 White et al. ..... 224/48
4,219,144 A * 8/1980 Hagelberg ..... 229/406
5,152,398 A * 10/1992 Forestal et al. ..... 206/561
5,323,910 A * 6/1994 van de Graaf, Jr. ..... 206/557
5,346,070 A 9/1994 McSpadden ..... 206/561
5,429,231 A 7/1995 McSpadden ..... 206/217
5,429,266 A 7/1995 D'Oliveira et al. ..... 220/556
5,607,077 A * 3/1997 Torkelson ..... 220/575
5,947,011 A * 9/1999 Xu ..... 99/357
6,036,020 A * 3/2000 Distler ..... 206/564
6,129,235 A * 10/2000 Creske ..... 220/575
6,264,026 B1 7/2001 Bradley ..... 206/217

* cited by examiner

*Primary Examiner*—Jes F. Pascua
*Assistant Examiner*—Harry Grosso
(74) *Attorney, Agent, or Firm*—Mills Law Firm, PLLC

(57) ABSTRACT

A hand held serving tray includes a slotted well for stemmed and regular glasses, and a hole adjacent for gripping the top surface with a thumb and supporting the bottom surface with finger loosely surrounding the well.

10 Claims, 5 Drawing Sheets

HAND HELD SERVICE TRAY

FIELD OF THE INVENTION

The present invention relates to food trays and, in particular, to a hand held service tray for carrying edibles and beverages.

BACKGROUND OF THE INVENTION

At social gatherings and the like, it is common for attendees to be furnished with food and beverages to be consumed while interacting with other guests. Usually, a plate for edibles is carried in one hand and a beverage container is carried in the other hand. For drinking or eating one must be placed temporarily on a rest surface or placed on the plate, greatly increasing the possibility of spilling or confusion with the drink and food of others. Further, with both hands occupied it is difficult to socially interact in customary manners, such as hand shaking, gesturing and the like.

To overcome the above difficulties and disadvantages, various serving trays for holding both food and drinks with a single hand have been proposed. U.S. Pat. No. 3,401,858 to White discloses a service tray wherein a pair of openings are included in a rear wall of the tray to enable a user to hold both the tray and a beverage container. The cantilevered weight is borne entirely by the user's wrist. A similar tray is disclosed in U.S. Pat. No. 5,429,266 to D'Oliveira wherein the user grips an end portion of a tray having discrete areas for nesting a beverage glass and a food plate. The weight is also borne entirely by the user's wrist and requires constant gripping pressure. Further, any inadvertent wrist movement can result in instability or spillage.

To more evenly distribute the weight of the tray and contents, grasping surfaces on the bottom of the tray have been proposed. U.S. Pat. Nos. 5,346,070 and 5,429,231 to McSpladden disclose a cup like portion for holding a drink container that is grasped by the user's hand to support the tray and contents. Holding the tray is not only tiring but also requires forearm inclination for maintaining proper horizontal orientation to avoid spillage. A further approach is disclosed in U.S. Pat. No. 6,264,026 to Bradley wherein a serrated conical handle is provided on the bottom surface of the tray for grasping by the user. The tray includes food areas and a slotted glass holder for supporting stemmed glassware. The tray is adapted to be additionally supported by the forearm of the user. Nonetheless, the handle must be tightly and continuously grasped to prevent wobbling about the longitudinal or roll axis.

BRIEF SUMMARY OF THE INVENTION

The present invention provides a hand held serving tray for food and drinks which is stably held by one arm of a user that further increases tray stability to avoid spillage without continuous manual grasping of a handle. The tray includes a tray body having an integrally formed recessed and slotted glass holder for flat based or regular or stemmed glassware at the front and recessed food areas at the rear. A thumb hole is formed rearwardly and outwardly of the glass holder. The user holds the tray by inserting a thumb through the thumb hole to contact the upper tray surface while lightly surrounding the glass holder below the tray with the fingers. The hand is not required to tense to maintain stability and the light thumb and finger contact on opposed surfaces is effective to provide tray stability about vertical and longitudinal axes.

The rear of the tray is supported on the forearm of the user, jointly distributing the tray weight and preventing movement about the lateral axis. The foregoing allows the user to assume a natural holding position for the tray and contents while maintaining triaxial control of the tray position.

Accordingly, it is an object of the present invention to provide a hand held service tray that is conveniently and stably supported by one arm of a user.

Another object of the invention is to provide a service tray wherein the user's thumb is inserted through an aperture in the tray to engage a top tray surface while the fingers lightly surround a depending support on the bottom tray surface providing stable one arm support while carrying food and drink.

DESCRIPTION OF THE DRAWINGS

The above and other features of the present invention will become apparent upon reading the following description of the preferred embodiments taken in conjunction with the accompanying drawings in which.

DETAILED DESCRIPTION OF THE PREFERRED EMBODIMENTS

Figure 2:
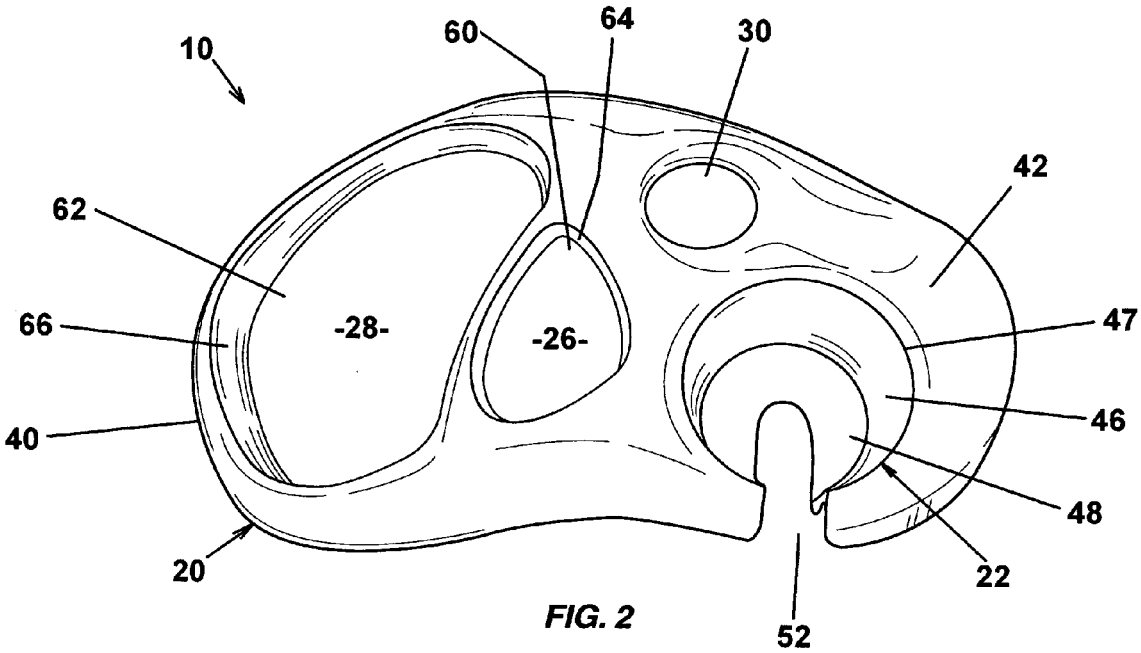
FIG. 2 is a top perspective view of tray of FIG. 1.
Figure 3:
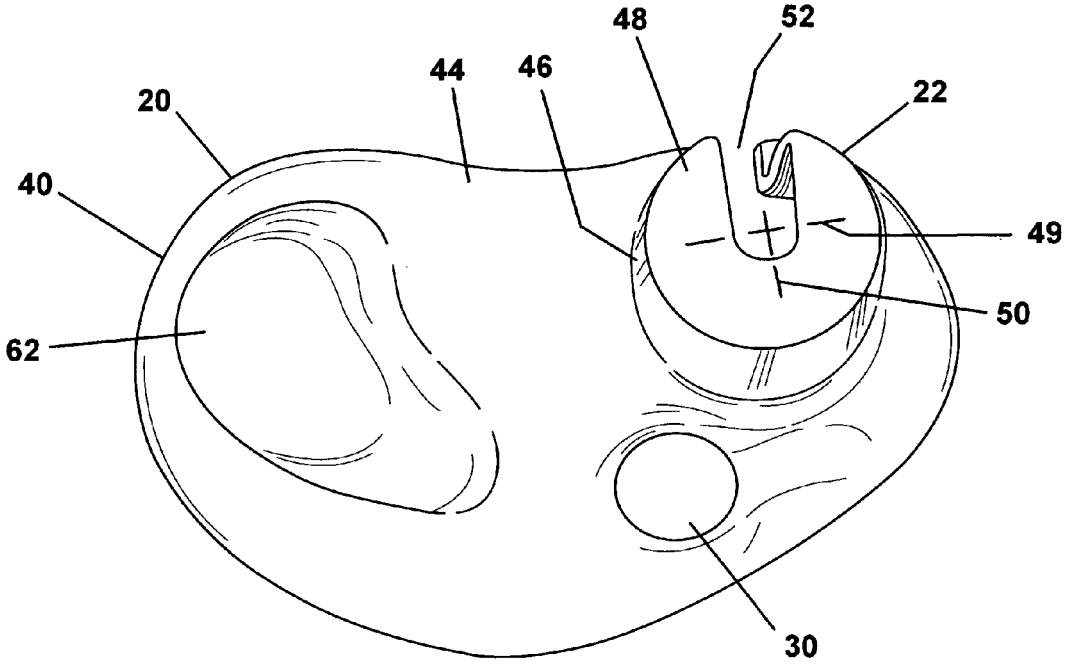
FIG. 3 is a bottom side perspective view of the tray of FIG. 1.

Referring additionally to FIGS. 2 and 3, the tray body 20 has a curvilinear shape, generally akin to an artist's palette, circumscribed by an outer peripheral edge 40 and top and bottom surfaces 42 and 44, respectively. The beverage holder 22 is formed at the front portion of the body 20 and includes an upwardly opening cavity formed by a frusto-conical wall 46 having a top annular rim 47 extending downwardly from the bottom surface 44 and a transverse circular base wall 48 having a longitudinal axis 49 with a transverse axis 50 normal thereto. An outwardly opening radial slot 52 is formed in the body 20, extending from the peripheral edge 40, through the wall 46 and partially through the base wall 48. The slot 52 is formed opposite the thumb hole 30 whereby the stem 54 of the wine glass 24 may be inserted therein by the right hand of the user, with the bowl 56 of the wine glass 24 nesting at the rim 47.

Referring additionally to FIGS. 2 and 3, the tray body 20 has a curvilinear shape, generally akin to an artist's palette, circumscribed by an outer peripheral wall 40 and top and bottom surfaces 42 and 44, respectively. The beverage holder 22 is formed at the front portion of the body 20 and includes an upwardly opening cavity formed by a frusto-conical wall 46 having a top annular rim 47 extending downwardly from the bottom surface 44 and a transverse circular base wall 48. An outwardly opening radial slot 52 is formed in the body 20, extending from the peripheral wall 40, through the wall 46 and partially through the base wall 48. The slot 52 is formed opposite the thumb hole 30 whereby the stem 54 of the wine glass 24 may be inserted therein by the right hand of the user, with the bowl 56 of the wine glass 24 nesting at the rim 47.

The food receptacles 26, 28 are dedicated area suitable for carrying articles adapted for the occasion. In the present embodiment, the receptacles are recessed areas formed in the rear section of the tray body 20. The receptacles may be formed in any shapes suitable for the intended use, defined by a base walls 60, 62 and peripheral walls 64, 66. A single area may also provided or an additional area incorporated for utensils. Additionally, rather than recesses, projecting surfaces may be provided for handling articles such as napkins, coasters, name tags and the like.

Figure 1:
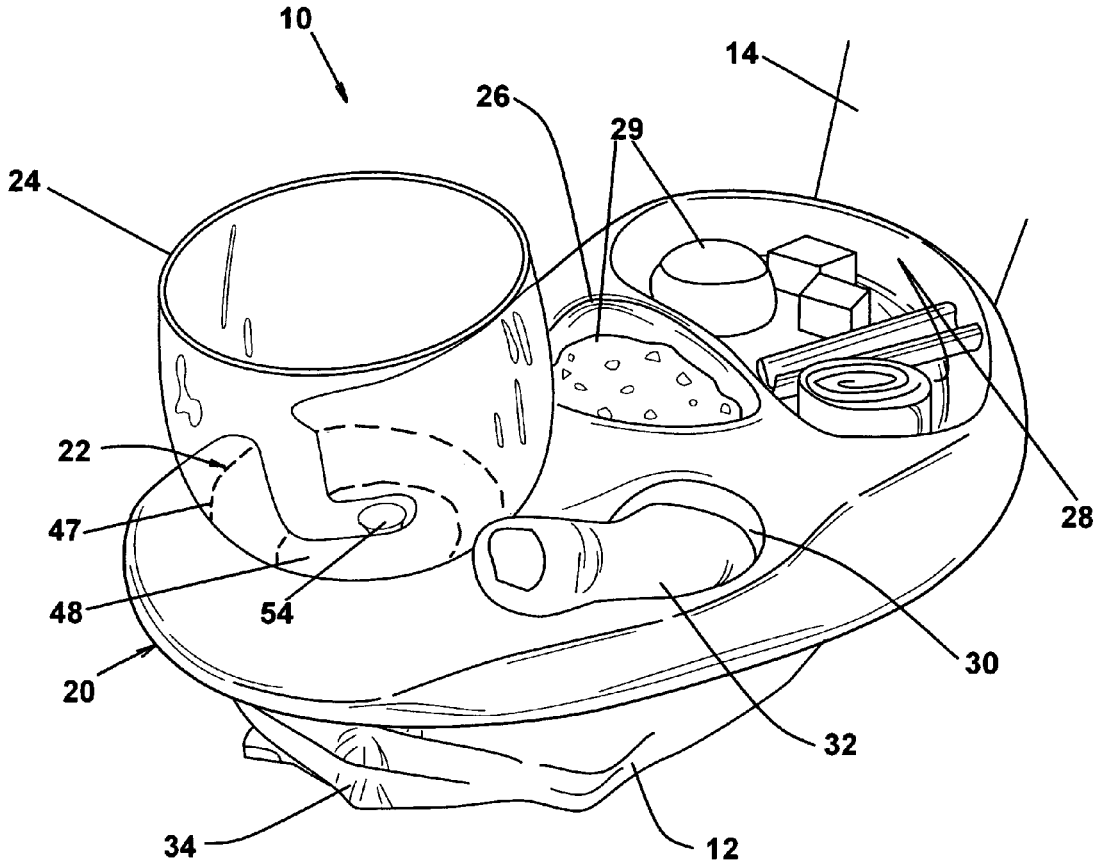
FIG. 1 is a top side perspective view of a hand held tray with drink holder in accordance with an embodiment of the invention.
Figure 4:
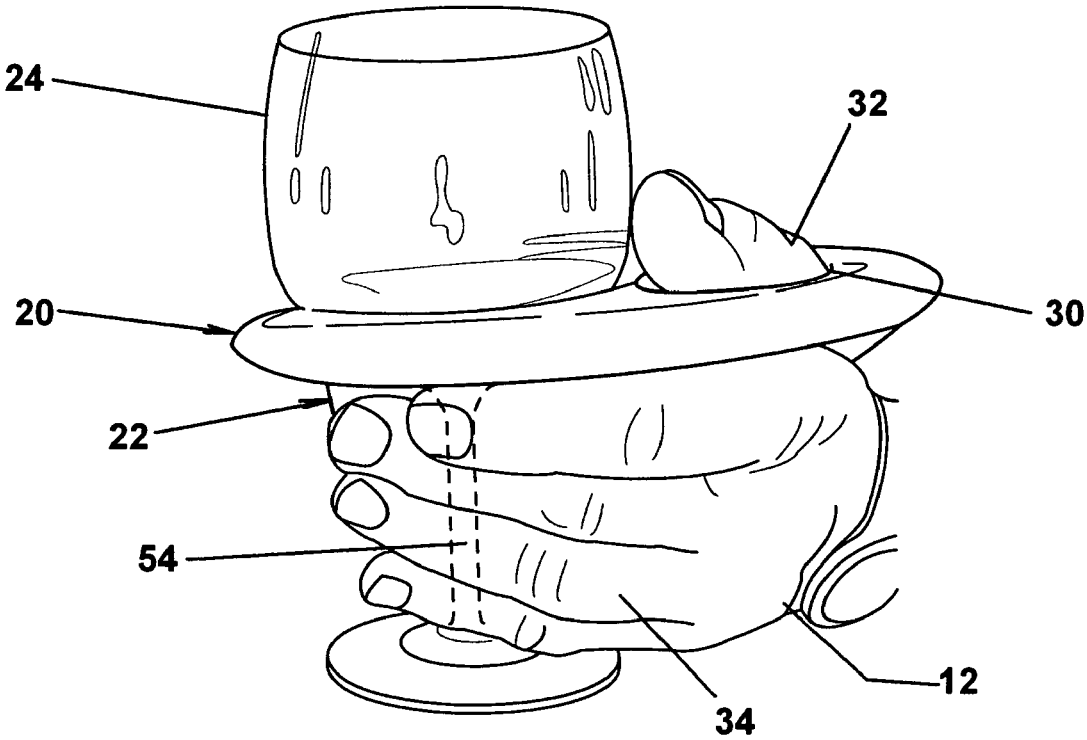
FIG. 4 is a front side perspective view of the tray of FIG. 1 carried by a user.
Figure 5:
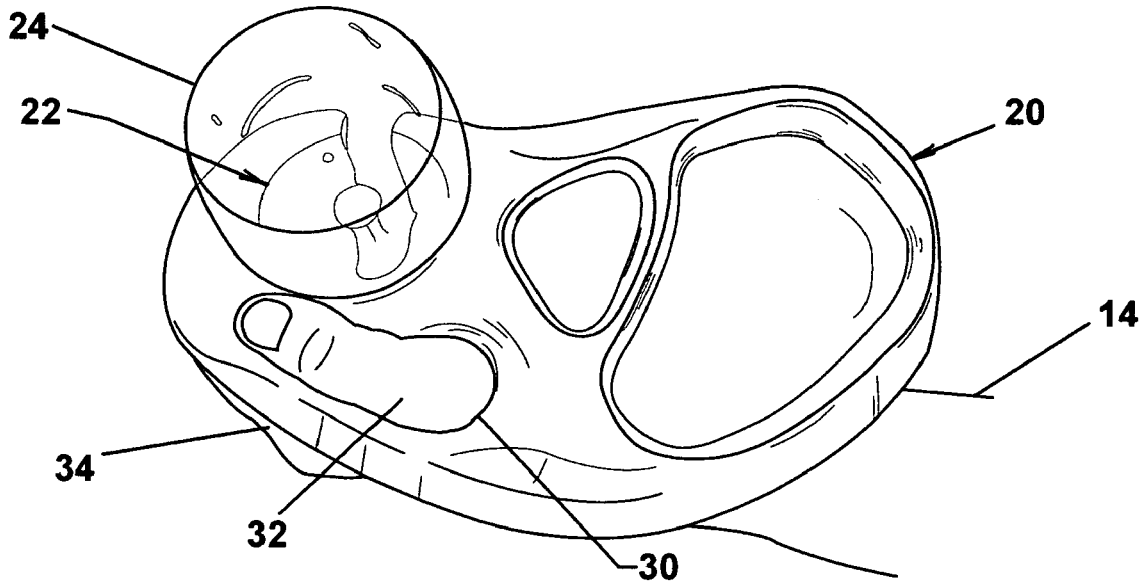
FIG. 5 is a top perspective view of the tray carried by a user.
Figure 6:
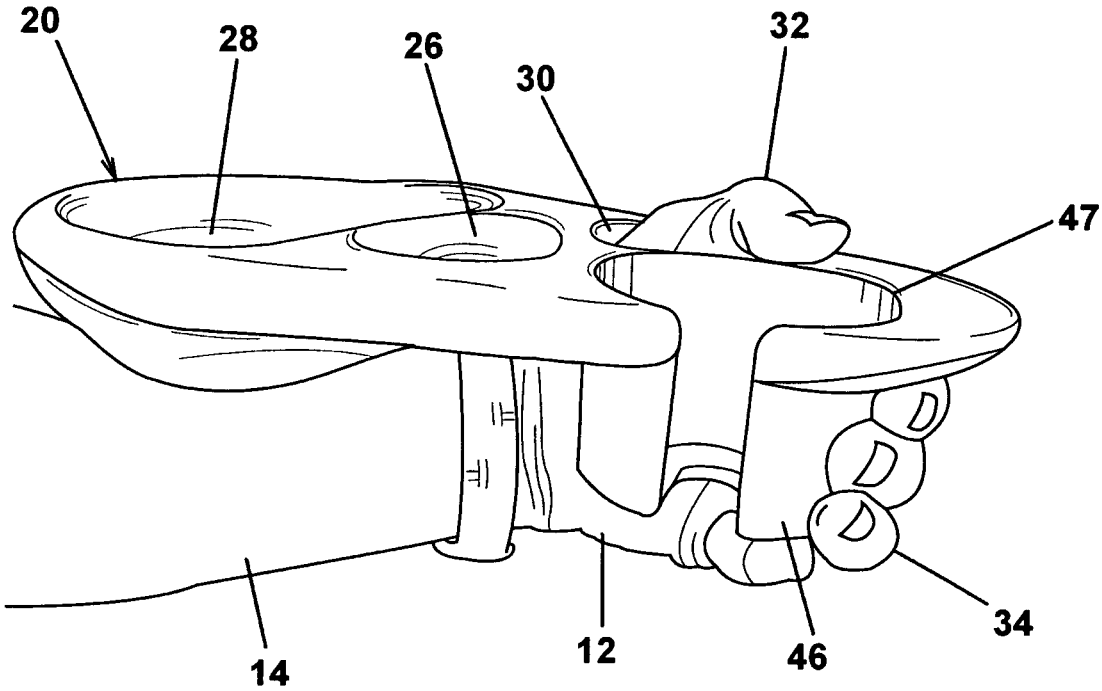
FIG. 6 is a side perspective view of the tray carried by a user.

In use, the rear bottom surface of the tray body including the base walls 60, 62 are supported by the forearm 14 whereby the hand of the user only needs to lightly grip the front section with the thumb and fingers to maintain stable orientation of the tray and the contents as shown in FIGS. 1 and 4. Thus the wrist of the user is slightly bent for a comfortable position.

The tray body 20 may be formed as a unitary article, in the illustrated sculpted form in cast thin wall or solid construction from plastic or mineral based materials, thin wall molded construction of durable, washable materials for multiple use, or in thin wall disposable materials for single use.

Figure 7:
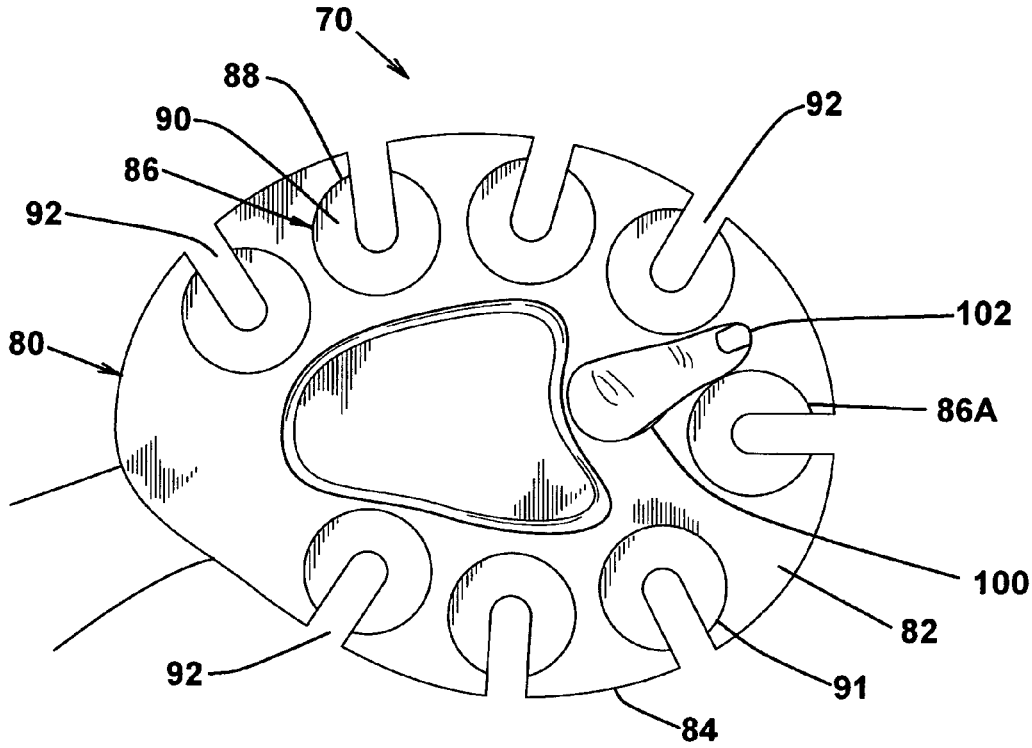
FIG. 7 is a top view of a serving tray in accordance with another embodiment of the invention.
Figure 8:
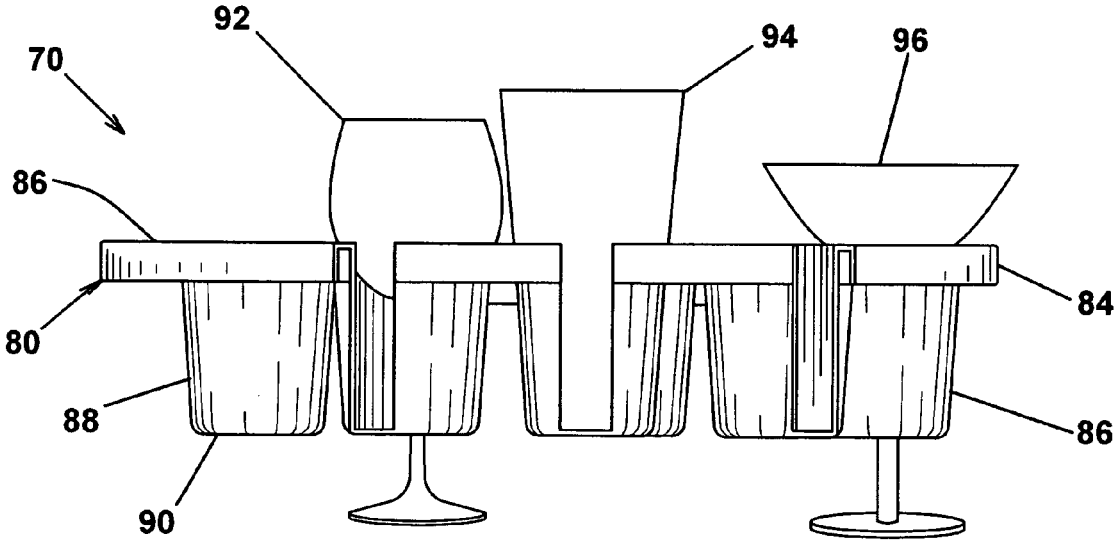
FIG. 8 is a side view of the tray of FIG. 7.

Another embodiment of the serving tray is shown in FIGS. 7 and 8 wherein a serving tray 70 is adapted for stably carrying a plurality of beverage containers of differing configurations, and allowing a server to distribute requested beverages from a standing position. Therein, the serving tray 70 comprises a one piece thin wall body 80 having a palette shaped top wall 82 circumscribed by a curvilinear peripheral wall 84. The body 80 includes a plurality of circumferentially shaped upwardly opening container holders 86 defined by downwardly extending frustoconical walls 88 and circular base walls 90. Outwardly opening access slots 92 are formed radially from the base walls 90 normal to the wall 84 allowing the passage of the stems of stemmed wine and specialty glasses. The holders are configured for carrying on the bases 90 flat bottom beverage containers in a confined nesting arrangement, and to support at the upper rim 91 of the walls 88, the outer surfaces of the stemmed containers. For example, the holders are adapted for supporting a martini-type stemmed glass 96, a wine glass 92, or a beverage glass 94. The tray body is also provided with a shallow center recess 98 for carrying ancillary goods attendant to the serving such as napkins, coasters, straws and the like.

To facilitate stable ergonomic carrying as in the previously described embodiment, a thumb hole 100 is formed through the top wall rearwardly and outwardly of the frontal holder 86A to enable the server to support the tray with the server's thumb 102 extending through the hole 100 and engaging the top surface and the fingers lightly surrounding the wall of the frontal well. The rearward portion of the tray is supported by the forearm of the server. Accordingly, the server may circulate the serving area and dispense the beverages with the free hand, maintaining a stable support of the tray to avoid spilling contents.

The beverage wells as described above are configured for supporting flat based beverage containers, such as glasses cans and bottles; and stemmed beverage containers, such as wine glasses, martini glasses and specialty glasses having upper portions holding the beverage and a downwardly depending stems. The holders are preferably configured for supporting a range of generally available containers. A holder with a 2½ to 3 inch base and a 3 to 3½ inch upper rim has been determined to be suitable. Also, the thumb hole should be positioned rearwardly and laterally outwardly of the front holder. This establishes a holding position as shown in FIGS. 1 and 4 wherein the thumb 32 generally overlies the base of the index finger in a comfortable, natural position, the first three fingers lightly partially surround the holder wall, the wrist is slightly curved inwardly, and the rear portion of the tray rests on the front forearm 14. It is preferred that the thumb hole 30 be located at an angle of about 30° to 75° , and preferably about 45° to 60°, from the transverse axis of the tray at a radius of about 2 to 3 inches from the center of the base wall, the with the slot 52 opening laterally in an opposed direction, inwardly toward the other hand of the user/server. Thus the server is able to comfortably support the tray in one hand, and load, carry and distribute or utilize the contents with the other hand in a standing and mobile position.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed is:

1. A hand held service tray for carrying beverages and accessories on the hand of a user in a carrying position, comprising: a tray body having an upper surface and a lower surface circumscribed by a peripheral edge; a front beverage container holder formed at an inward front portion of said tray body with reference to the carrying position, said beverage container holder defined by a peripheral wall downwardly depending from said bottom surface and a base wall transverse thereto, said base wall prescribing a longitudinal axis and a transverse axis wherein said container holder is configured for receiving a beverage container on said base wall; a first recessed receptacle formed at a rear portion of said tray body for carrying said accessories and supported by the forearm of a user in the carrying position; aperture means formed vertically through said tray body rearwardly of said transverse axis and laterally outwardly of said base wall of said front beverage container holder and laterally outwardly of said longitudinal axis, said aperture means upwardly receiving the thumb of the user enabling contacting said upper surface of said tray body and enabling the fingers of the user to extend inwardly to contact the bottom surface and partially surround said peripheral wall to provide stable orientation on the hand of the user in the carrying position and permit the reception and distribution of said beverage and accessories.

2. The hand held service tray as recited in claim 1 wherein said peripheral wall of said holder is frustoconical and of sufficient height for accommodating at least three fingers of the hand of the user in said holding position.

3. The hand held service tray as recited in claim 2 wherein said aperture means is located for positioning the thumb of the user above the fingers of the user in the holding position.

4. The hand held service tray as recited in claim 1 wherein said tray body is a one-piece molded construction.

5. The hand held service tray as recited in claim 4 wherein said tray body is a thin wall one-piece molded construction.

6. The hand held service tray as recited in claim 1 including a plurality of secondary container holders disposed about the periphery of said tray body.

7. The hand held service tray as recited in claim 6 including outwardly opening access slots registering with said secondary container holders for accommodating the stems of stemmed containers carried therein.

8. The hand held service tray as recited in claim 1 wherein said aperture means is located rearwardly and outwardly of said holder at an angle of about 30° to 75° to said transverse axis through said base wall of said holder.

9. The hand held service tray as recited in claim 8 wherein said aperture means is located within 2 to 3 inches from the center of said base wall of said holder.

10. The hand held service tray as recited in claim 1 wherein said beverage container holder has a circular opening at a support rim at said upper surface and including an outwardly opening slot formed in said tray body extending from said base wall through said peripheral wall and said peripheral edge the arrangement being such that a stemmed beverage container with an upper beverage container portion is supported by said support rim and a depending stem extends thorough said slot whereby the stemmed beverage container may be removed by inward movement with the other hand of the user.

* * * * *